United States Patent [19]

Borofsky et al.

[11] 4,321,804

[45] Mar. 30, 1982

[54] ADJUSTABLE NECKLACE OR BRACELET

[76] Inventors: Margaret Borofsky, 14 Greenway La., Greenfield, Mass. 01301; Robert L. Borofsky, 22 Wilsondale St., Dover, Mass. 02030

[21] Appl. No.: 183,009

[22] Filed: Sep. 2, 1980

[51] Int. Cl.[3] ..... A44C 25/00

[52] U.S. Cl. ..... 63/2; 24/115 H

[58] Field of Search ..... 63/1, 2, 5 R; 24/115 H, 24/116 R, 115 R; 2/311

[56] References Cited

U.S. PATENT DOCUMENTS

| | | | |
|---|---|---|---|
| 118,294 | 8/1871 | Stevens | 24/115 H |
| 860,169 | 7/1907 | Chatfield | 24/115 R |
| 1,124,518 | 1/1915 | Qvarnstrom | 24/115 R |
| 2,462,425 | 2/1949 | Pratt et al. | 63/2 X |
| 2,861,313 | 11/1958 | Ruf | 24/115.4 |
| 2,961,855 | 11/1960 | Newman | 63/15.65 |
| 3,481,155 | 12/1969 | Cook | 63/2 |
| 4,237,702 | 12/1980 | Caverly | 63/2 |

FOREIGN PATENT DOCUMENTS

| | | | |
|---|---|---|---|
| 1110948 | 10/1955 | France | 24/115 H |
| 319690 | 2/1957 | Switzerland . | |
| 16468 | of 1887 | United Kingdom | 63/5 R |

*Primary Examiner*—F. Barry Shay

*Attorney, Agent, or Firm*—Richard P. Crowley

[57] ABSTRACT

An adjustable necklace or bracelet which comprises: a length of chain having a one end and another end; first and second engaging elements having passageways therethrough; means to secure the one end of the chain to the second engaging element, after the chain passes through the passageway of the first element; means to secure the other end of the chain element to the first engaging element, the chain element passing through the passageway of the second engaging element; and means to engage frictionally the exterior of the chain element in the passageways of the first and second elements, to permit the chain element to be engaged in a slidable manner in each passageway and to secure the chain element in position after movement.

2 Claims, 2 Drawing Figures

ADJUSTABLE NECKLACE OR BRACELET

BACKGROUND OF THE INVENTION

The field of this invention relates to and is concerned with jewelry, particularly necklaces, bracelets, belts or other devices and pieces of jewelry designed to encircle parts of the body, and particularly those devices used for display and ornamental purposes and made of precious metals. It is often desirable to adjust the circumference of a necklace, bracelet or belt, either for the purpose of placing the item on the body or for being removed from the body. It is further usually desirable that the adjustment of the circumference or the diameter of the device be made easily and rapidly in a simple fashion by the user, without detracting from the ornamental or decorative nature of the jewelry device. Typically, a necklace, bracelet or belt comprises an encircling chain or loop of material usually of a metal, such as gold, silver, brass or the like, and adjustment in the diameter or circumference is made by altering the position of one or the other end of the chain or loop to the loop material. It would be desirable to provide for a more rapid, economical, simple adjustment in the circumference of a device, such as a necklace or bracelet, without detracting from the ornamental or decorative nature of the device.

SUMMARY OF THE INVENTION

Our invention concerns and relates to an adjustable circumferential device, particularly jewelry, such as an adjustable necklace, bracelet or belt, and to the method of adjusting the circumference of the device.

Our invention comprises an adjustable, closed-loop, jewelry device having a circumference or diameter subject to adjustment, and which device includes an elongated length of a chain or other string-like element, such as a chain of metal or other material having a plurality of interconnecting links or loops therein, and having a one end and another end which, when joined, form a closed loop. The device includes a pair of engaging elements adapted to encircle the chain element, with each engaging element having a defined passageway therethrough, which passageway is adapted to permit the passage of the chain element therethrough. Typically, the passageway through the engaging element is made slightly greater than the diameter of the chain element, so as to permit the chain element to be slid therethrough, but to fit in a snug fashion. One end of the chain element is secured to one of the engaging elements, and the other end of the chain element is secured to the other engaging element, after each of the chain elements have been passed through the passageway of the other engaging element. Each end of the chain element is secured, such as by a decorative link or a loop, typically to the exterior surface of the engaging element, or, if desired, may be soldered or directly secured by adhesive or other means to the surface of the engaging element, but preferably in a decorative and an ornamental manner, where a jewelry device is involved. The engaging or chain-encircling elements employed may be the same or different and may vary in form and shape and appearance, so as to present a decorative or an ornamental surface or appearance, but typically are composed of sufficient size to encircle the chain and to be grasped by the user during the adjustment procedure. The engaging elements should permit the passage of the chain element through the passageways therein.

In one embodiment, the chain-encircling or engaging elements may be formed of the same or different material; for example, of a precious metal, such as gold or silver, as the chain element. The engaging elements, for example, may comprise a spherical element, a tubular element or an element having a decorative outer surface and shape.

The closed-loop device of our invention also includes, with at least one engaging element, but preferably with both engaging elements, a chain-stopping, -securing or -engaging mechanism, to secure and retain the chain element in the passageway in a secure, but slidable, condition, so that, after adjustment of the chain element to the desired circumference, the chain element will remain so that the device may be worn by the user without further movement.

In one embodiment, the interior of the engaging elements may contain a friction-engaging sleeve or coating of material, such as a natural or synthetic polymer, such as, for example, a rubber material like neoprene or other material having high friction properties. This sleeve material is placed in contact with the exterior surface of the chain element passing through the passageway, in order to provide for a snug, but slidable, fit. The friction-engaging material may be placed on all or a portion of the interior surface of the passageway and positioned and selected, so that the chain element may be pulled or slid by the user through the passageway with slight force, permitting the adjustment of the chain to the desired circumference, and then, on adjustment, the chain element secured in position by frictionally engaging the exterior surface of the chain element in the passageway.

In operation, the device is adapted by sliding both the engaging elements, to adjust the circumference of the closed-loop chain formed by the chain element. Our invention will be described for the purpose of illustration only, using a particular friction-engaging means. However, it is recognized that other mechanisms, such as clasps, snaps or other mechanical mechanisms, which engage the surface of the chain element in the passageway through the use of friction or other means, may be used, to permit a slidable adjustment of the chain element.

Our invention will be described for the purpose of illustration only in connection with a piece of jewelry; that is, a necklace. However, it is recognized that our invention may be employed and used suitably in a wide variety of devices, particularly decorative devices which include a flexible chain element particularly used for ornamental or decorative purposes, to include necklaces, bracelets, anklets, belts and the like.

DESCRIPTION OF THE EMBODIMENTS

Figure 1:
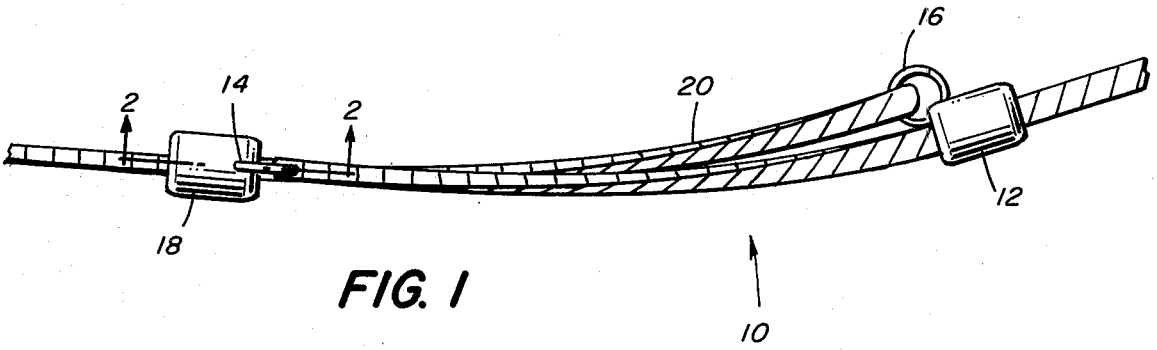
FIG. 1 is a schematic representation of an adjustable necklace of our invention.
Figure 2:
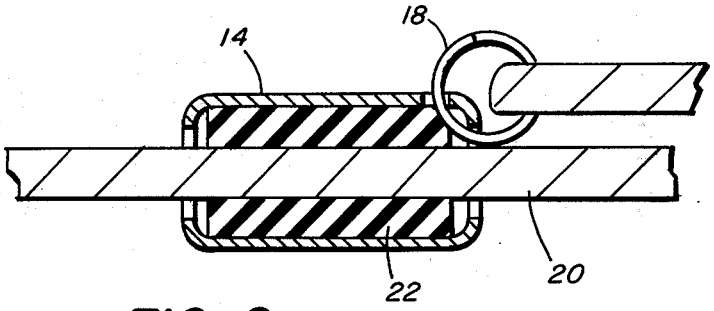
FIG. 2 is a cross-sectional view along lines 2—2 of FIG. 1 of the necklace of our invention.

With reference to FIGS. 1 and 2, there is shown a necklace 10 composed of a flexible metal chain 20, such as a gold chain composed of a series of gold links. The necklace includes a pair of spaced-apart, engaging gold cylinders 12 and 14, each of which cylinders has a tubular passageway therein, and each passageway containing a tubular insert or sleeve composed of a rubber material 22; for example, of neoprene rubber, which provides and serves as a friction-engaging surface in combination with the surface of the chain 20 passing through each of the passageways. The chain 20 at each end is passed through a tubular passageway, and then the one end of the chain is secured to a loop 16 secured on the cylinder 12, and the other end of the chain is secured to a loop 18 on the other engaging cylinder 14, to form, between the spaced-apart cylinders 12 and 14, a double length of the chain 20. Each cylinder passageway has inlet and outlet openings of a size to give clearance to the chain as it passes in and out of the cylinder, as shown in FIG. 1. This avoids contact of the cylinders and chain during adjustment. The passageways in each cylinder 12 and 14 are dimensioned, so that the chain 20 may, with a slight pull by the user, be slid through the elastomeric sleeved passageway, but will be retained in position after adjustment. Cylinders 12, 14 are connected to loops 16, 18 at their mutually adjacent ends (facing each other in FIG. 1), and are connected adjacent the passageway openings. If simply grasped at the extreme ends in FIG. 1 and pulled, the pull will be generally aligned with the direction of the cylinder passageways.

In operation, the necklace 10 is adjusted to the desired circumference by the user's grasping one or both cylinders 12 and 14 slidably moving the cylinders along the chain 20; thus, passing the chain 20 through each passageway, to obtain the desired circumference of the closed-loop chain. As illustrated, when engaging cylinders 12 and 14 are slid away from each other, as shown in FIG. 1, the circumference of the necklace is thereby decreased.

Having thus described our invention, what we claim is:

1. An adjustable, closed-loop, jewelry device, such as a necklace, bracelet or belt, which device comprises:

(a) a defined length of a metal chain element housing a substantially uniform cross section and having a one end and another end;

(b) first and second, generally cylindrical, housing elements, each housing element having a straight, generally tubular passageway therethrough and having aligned inlet and outlet passageway openings, the inlet and outlet openings larger than the cross section of the chain element;

(c) ring-like means to secure the one end of the chain element to the second housing element, the chain element passing through the passageway of the first housing element;

(d) ring-like means to secure the other end of the chain element to the first housing element, the chain element passing through the passageway of the second housing element;

(e) first and second sleeve insert means positioned respectively within the first and second housing elements, the insert means having straight, generally tubular passageways therethrough defining inlet and outlet openings and composed of a frictionally engaging, synthetic, elastomeric material, the inlet and outlet openings thereof being smaller than and aligned with the respective inlet and outlet passageways of the housing elements, the insert means retained within the housing elements by radially downwardly extending lip elements at each end of the housing elements, which lip elements define the inlet and outlet passageways of said housing elements, and the interior surface of the tubular passageways in a generally uniformly and snugly fitted relationship about and with the exterior surface of the chain element passing therethrough, so as to permit the chain element to be engaged in a slidable, snug, friction manner in each tubular passageway substantially along the full length and about the exterior surface of the chain element within each insert passageway, to secure the chain element in position after adjustment;

(f) said ring-like means being secured at the mutually adjacent ends of the respective ones of said housing elements adjacent said passageway openings to provide means whereby, when said housing elements are unrestrained an opposed pull is exerted on said chain in a manner to increase its circumference, the direction of said pull is generally aligned with the direction of said passageways; and (g) the difference in size between the housing element openings and the cross section of the chain element providing means to allow relative movement of the chain element therethrough without abrasive contact therebetween.

2. The device of claim 1 wherein the insert means are composed of a neoprene rubber material.

* * * * *